US010852666B2

(12) United States Patent
Nakai

(10) Patent No.: US 10,852,666 B2
(45) Date of Patent: Dec. 1, 2020

(54) POWDER CONTAINER AND IMAGE FORMING APPARATUS

(71) Applicant: FUJI XEROX CO., LTD., Tokyo (JP)

(72) Inventor: Daisuke Nakai, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/654,645

(22) Filed: Oct. 16, 2019

(65) Prior Publication Data

US 2020/0310293 A1 Oct. 1, 2020

(30) Foreign Application Priority Data

Apr. 1, 2019 (JP) ..... 2019-069577

(51) Int. Cl.
*G03G 15/08* (2006.01)

(52) U.S. Cl.
CPC ..... *G03G 15/0872* (2013.01); *G03G 15/0868* (2013.01); *G03G 15/0877* (2013.01); *G03G 2215/0668* (2013.01)

(58) Field of Classification Search
CPC ..... G03G 15/087; G03G 15/0865; G03G 15/0867; G03G 15/0868; G03G 15/0872; G03G 15/0877; G03G 15/0879; G03G 2215/066; G03G 2215/0663; G03G 2215/0665; G03G 2215/0668; G03G 2215/0678
See application file for complete search history.

(56) References Cited

U.S. PATENT DOCUMENTS

| | | | | |
|---|---|---|---|---|
| 6,256,469 | B1 | 7/2001 | Taniyama et al. | |
| 2017/0052479 | A1 | 2/2017 | Oba et al. | |
| 2018/0113398 | A1* | 4/2018 | Yukimoto ..... | G03G 15/0872 |

FOREIGN PATENT DOCUMENTS

| | | | |
|---|---|---|---|
| JP | 2001-228692 | A | 8/2001 |
| JP | 2017-040673 | A | 2/2017 |

* cited by examiner

*Primary Examiner* — Thomas S Giampaolo, II
(74) *Attorney, Agent, or Firm* — Sughrue Mion, PLLC

(57) ABSTRACT

A powder container includes a bottle body that accommodates powder and has, at one end, an opening through which the powder flows out. The bottle body is positioned with the opening facing laterally and set rotatable about a rotation center line extending laterally through a center of the opening. The bottle body has an inner peripheral surface on which a spiral protrusion is formed to transport the accommodated powder toward the opening through the rotation. When the bottle body is sectioned vertically on a plane including the rotation center line, the spiral protrusion causes plural upwardly protruding projections to appear on a cross-section, the plural projections include a first projection and a second projection closer to the opening than the first projection, and an opening-facing face of the second projection has a bottom lower than a top of the first projection or the opening has a lower edge lower than the top of the first projection.

11 Claims, 8 Drawing Sheets

POWDER CONTAINER AND IMAGE FORMING APPARATUS

CROSS-REFERENCE TO RELATED APPLICATIONS

This application is based on and claims priority under 35 USC 119 from Japanese Patent Application No. 2019-069577 filed Apr. 1, 2019.

BACKGROUND

(i) Technical Field

The present disclosure relates to a powder container and an image forming apparatus.

(ii) Related Art

An image forming apparatus which uses toner to form an image has a replaceably installed toner bottle which accommodates toner. In such an image forming apparatus, toner is supplied from the toner bottle and used in the formation of an image. When the toner bottle becomes empty, the toner bottle is replaced with new one. Before the replacement of the toner bottle, the toner in the toner bottle should be consumed as much as possible, in other words, the residual toner should be reduced as much as possible.

In this regard, JP-A-2001-228692 discloses a toner cartridge having an inner peripheral surface on which a spiral protrusion is formed to transport the accommodated toner toward an opening through rotation.

In addition, JP-A-2017-040673 discloses a toner bottle having a tapered portion decreasing in diameter toward an opening and a main body portion more distant from the opening than the tapered portion, the toner bottle having an inner peripheral surface on which a spiral protrusion is formed with pitches in which the pitch in the tapered portion is narrower than the pitch in the main body portion.

SUMMARY

Aspects of non-limiting embodiments of the present disclosure relate to providing a powder container that can more reduce the remaining amount of powder at the time of replacement, even when having a different size portion such as a tapered portion decreasing in diameter toward its opening, than a powder container having an inner peripheral surface on which a spiral protrusion is formed with a constant height, and also relate to providing an image forming apparatus in which such a powder container is installed.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a powder container including: a bottle body that accommodates powder and has, at one end, an opening through which the powder flows out, the bottle body being positioned with the opening facing laterally and being set rotatable about a rotation center line extending laterally through a center of the opening, the bottle body having an inner peripheral surface on which a spiral protrusion is formed to transport the accommodated powder toward the opening through the rotation, wherein when the bottle body is sectioned vertically on a plane including the rotation center line, the spiral protrusion causes plural upwardly protruding projections to appear on a cross-section, the plural projections include a first projection and a second projection closer to the opening than the first projection, and an opening-facing face of the second projection has a bottom lower than a top of the first projection or the opening has a lower edge lower than the top of the first projection.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the present disclosure will be described.

Figure 1:
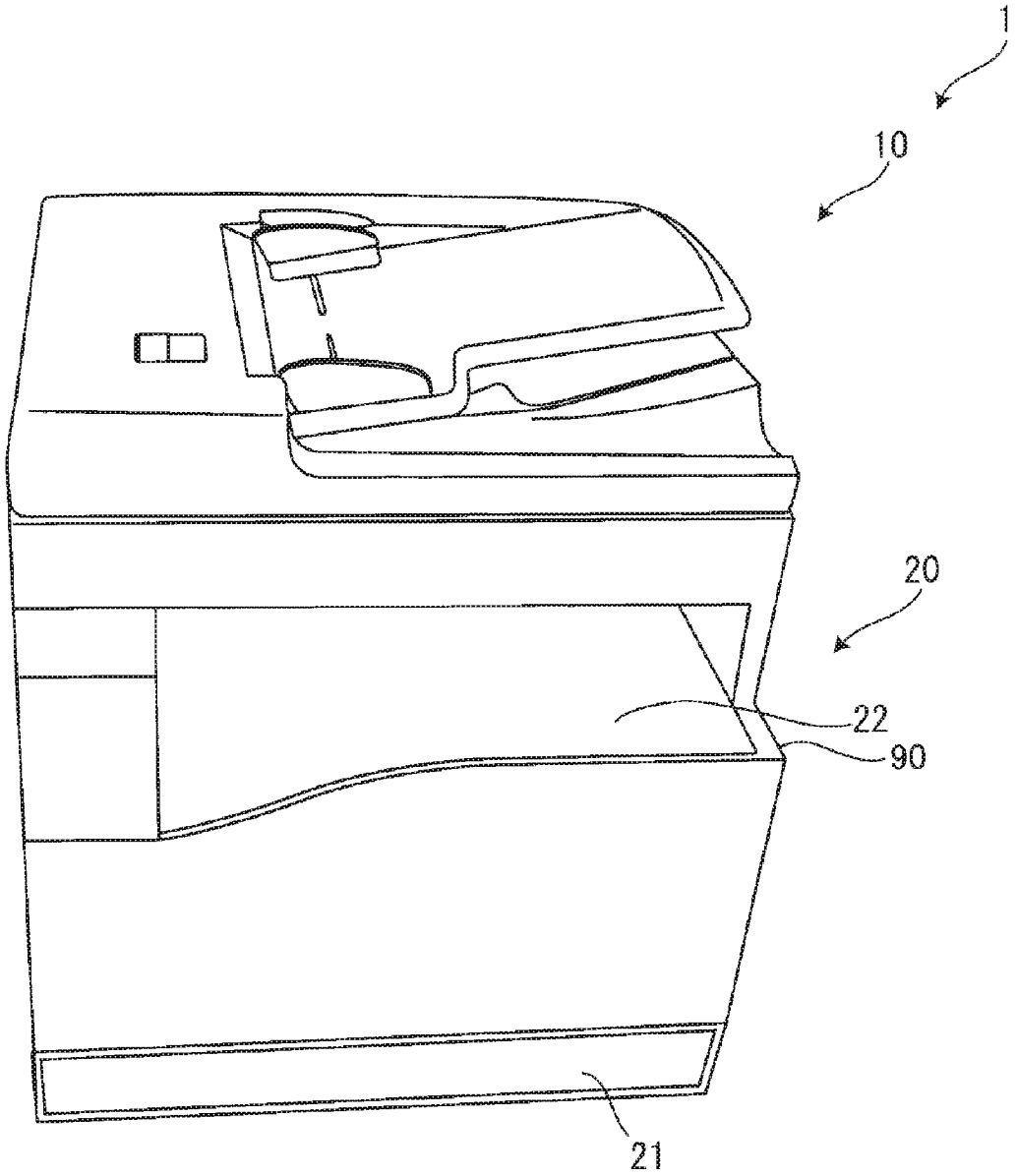
FIG. 1 is an external perspective view of an image forming apparatus according to an exemplary embodiment of the present disclosure.

FIG. 1 is an external perspective view of an image forming apparatus as an exemplary embodiment of the present disclosure.

The image forming apparatus 1 includes a scanner 10 and a printer 20.

The scanner 10 is mounted on an apparatus casing 90 which is a framework of the image forming apparatus 1, and the printer 20 is formed in the apparatus casing 90.

Figure 2:
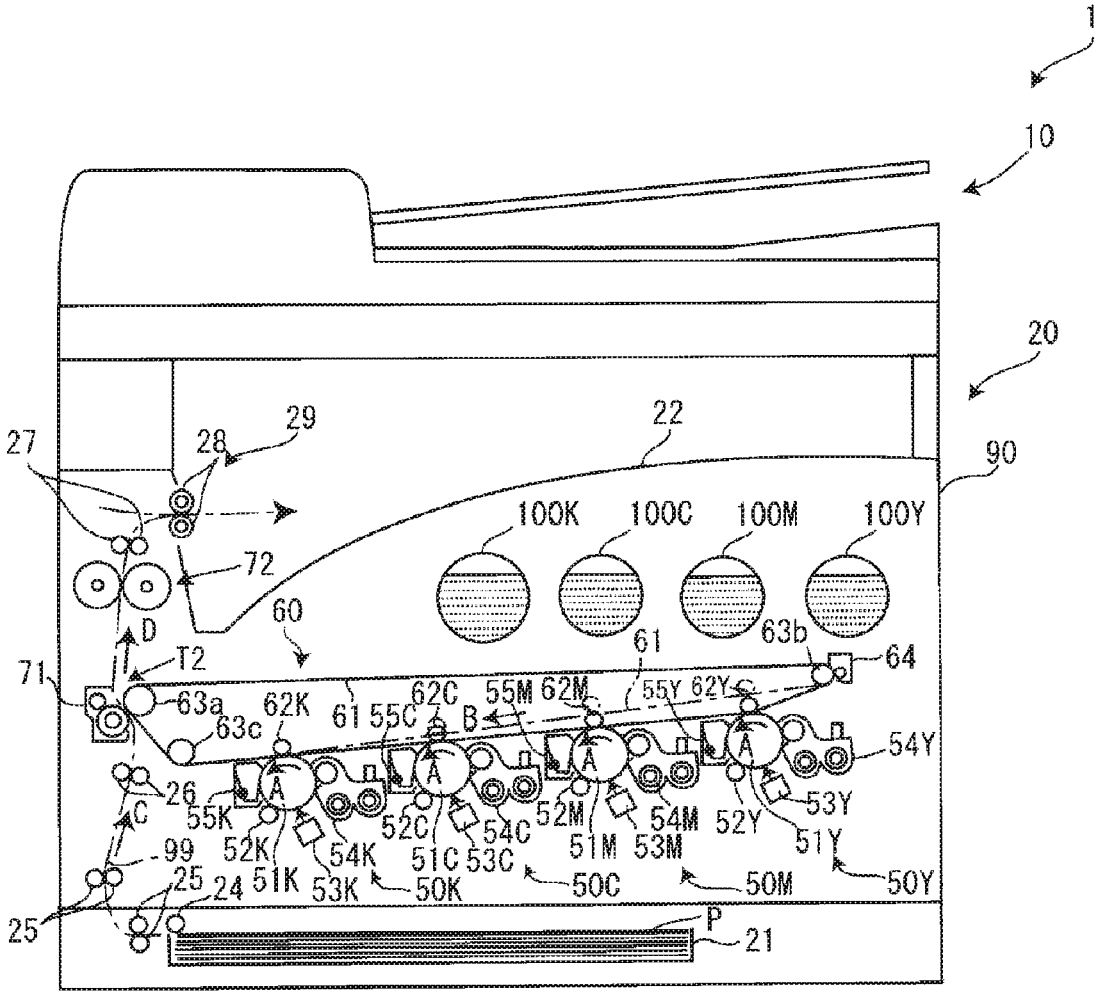
FIG. 2 is a schematic diagram illustrating an internal configuration of the image forming apparatus having an appearance illustrated in FIG. 1.

FIG. 2 is a schematic diagram illustrating an internal configuration of the image forming apparatus having an appearance illustrated in FIG. 1.

The printer 20 includes four image forming units 50Y, 50M, 50C, and 50K substantially horizontally arranged in a row. These image forming units 50Y, 50M, 50C, and 50K form toner images from color toners of yellow (Y), magenta (M), cyan (C), and black (K), respectively. Hereinafter, when features common to the image forming units 50Y, 50M, 50C, and 50K are described, the symbols Y, M, C, and K for distinguishing the toner colors will be omitted, and the term "image forming unit 50" will be used. The same applies to components other than the image forming units.

Each image forming unit 50 has a photoreceptor 51. While receiving a driving force, the photoreceptor 51 rotates in a direction of the arrow A so that an electrostatic latent image is formed on its surface, and then, a toner image is formed by development.

A charger 52, an exposure device 53, a developing device 54, a primary transfer device 62, and a cleaner 55 are provided around each photoreceptor 51 in each image forming unit 50. In this structure, the primary transfer device 62 and the photoreceptor 51 are located with an intermediate transfer belt 61 described below interposed therebetween. The primary transfer device 62 is not an element of the image forming unit 50 but an element of an intermediate transfer unit 60 described below.

The charger 52 uniformly charges the surface of the photoreceptor 51.

The exposure device 53 applies exposure light to the uniformly charged photoreceptor 51, in which the exposure light is modulated based on an image signal, so that an electrostatic latent image is formed on the photoreceptor 51.

The developing device 54 develops the electrostatic latent image formed on the photoreceptor 51 by using toner of a color corresponding to each image forming unit 50 to form a toner image on the photoreceptor 51.

The primary transfer device 62 transfers the toner image formed on the photoreceptor 51 onto the intermediate transfer belt 61 described below.

The cleaner 55 removes residual toner and the like from the photoreceptor 51 after the transfer.

The intermediate transfer unit 60 is disposed above the four image forming units 50. The intermediate transfer unit 60 has the intermediate transfer belt 61. The intermediate transfer belt 61 is supported by plural rolls including a driving roll 63*a*, a driven roll 63*b*, and a tension roll 63*c*. The intermediate transfer belt 61 is driven by the driving roll 63*a* to circulate in a direction of the arrow B on a circulation path including a path along the four photoreceptors 51 in the four image forming units 50.

The toner images on the respective photoreceptors 51 are sequentially superimposed and transferred onto the intermediate transfer belt 61 by the action of the primary transfer device 62. The toner image transferred onto the intermediate transfer belt 61 is transported to a secondary transfer position T2 by the intermediate transfer belt 61. A secondary transfer device 71 is provided at the secondary transfer position T2, and the toner image on the intermediate transfer belt 61 is transferred onto paper P transported to the secondary transfer position T2 by the action of the secondary transfer device 71. The transport of the paper P will be described later. After the transfer of the toner image onto the paper P, the toner and so on remaining on the intermediate transfer belt 61 is removed from the intermediate transfer belt 61 by a cleaner 64.

A toner cartridge 100 which accommodates toner of each color is provided above the intermediate transfer unit 60. When toner in the developing device 54 is consumed by development, toner is supplied to the developing device 54 from the toner cartridge 100, which accommodates the corresponding color toner, through a toner supply path (not illustrated). The toner cartridge 100 is configured to be attachable to and detachable from the apparatus casing 90. When the toner cartridge 100 is empty, the toner cartridge 100 is taken out and a new toner cartridge 100 is attached.

One sheet of paper P is taken out from a paper tray 21 by a pickup roll 24, and is transported by a transport roll 25 to a timing adjustment roll 26 in a direction of the arrow C through a transport path 99. The paper P transported to the timing adjustment roll 26 is fed by the timing adjustment roll 26 toward the secondary transfer position so that the paper P reaches the secondary transfer position T2 in accordance with a timing at which the toner image on the intermediate transfer belt 61 reaches the secondary transfer position T2. The paper P fed by the timing adjustment roll 26 receives the toner image from the intermediate transfer belt 61 by the action of the secondary transfer device 71 at the secondary transfer position T2. The paper P receiving the transfer of the toner image is further transported in a direction of the arrow D and passes through a fixing machine 72. The toner image on the paper P is heated and pressurized by the fixing machine 72 so that it is fixed on the paper P. In this manner, the toner image fixed on the paper P forms a printed image. The sheet on which the toner image is fixed by the fixing machine 72 is further transported by a transport roll 27 and then fed onto an output tray 22 through an output port 29 by an output roll 28.

Next, the structure of the toner cartridge 100 will be described.

Figure 3:
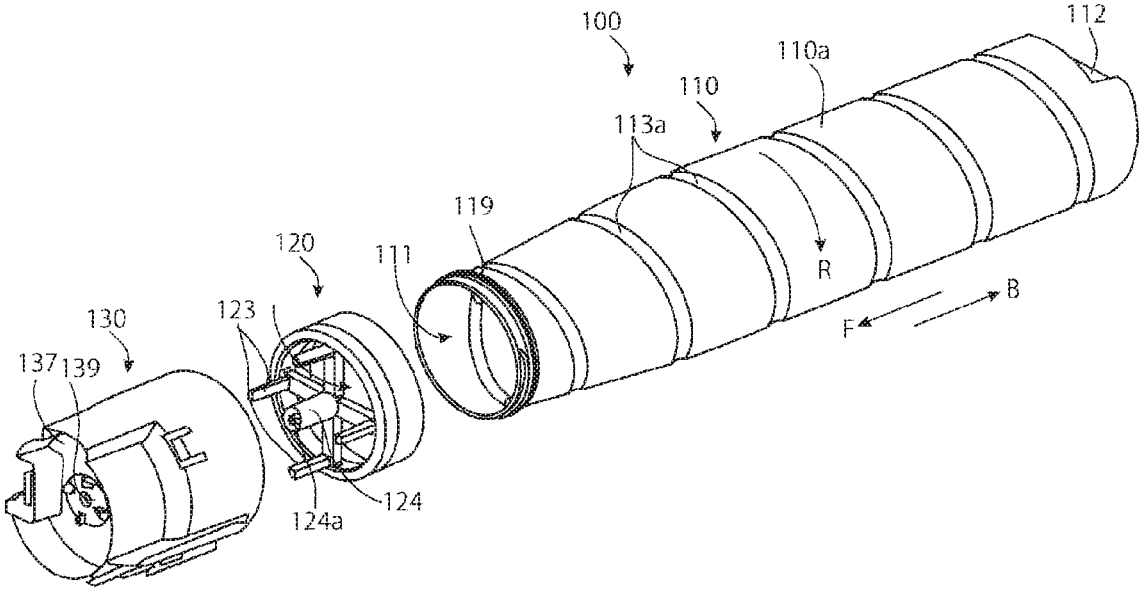
FIG. 3 is an exploded perspective view of a toner cartridge according to a first exemplary embodiment employed in the image forming apparatus illustrated in FIGS. 1 and 2.

FIG. 3 is an exploded perspective view of the toner cartridge according to a first exemplary embodiment employed in the image forming apparatus illustrated in FIGS. 1 and 2.

Figure 4A:
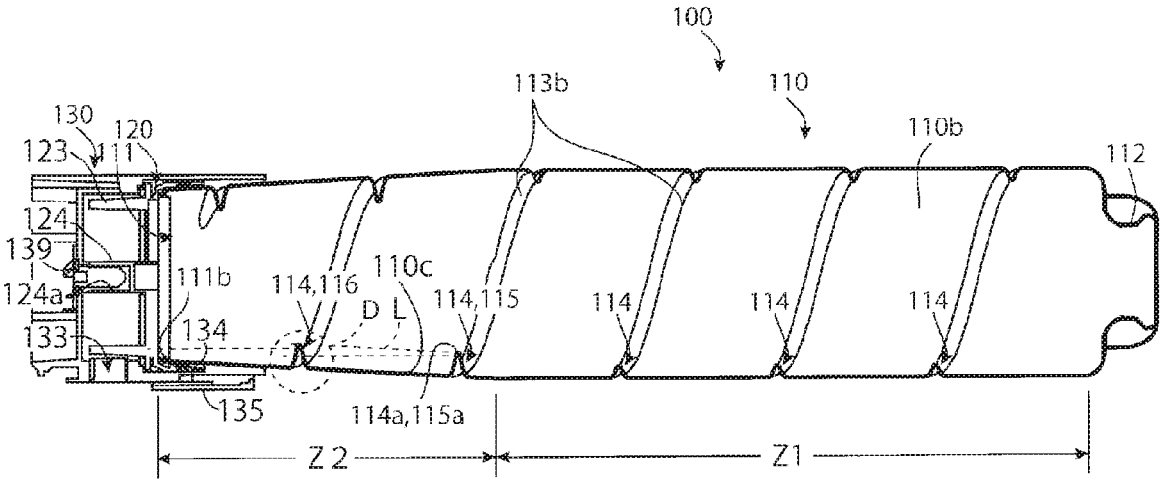
FIG. 4A is a longitudinal sectional view of the toner cartridge illustrated in FIG. 3.
Figure 4B:
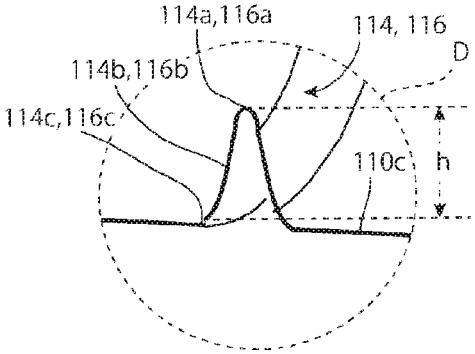
FIG. 4B is an enlarged view of a portion in a circle D on the longitudinal sectional view.

In addition, FIG. 4A is a longitudinal sectional view of the toner cartridge illustrated in FIG. 3, and FIG. 4B is an enlarged view of a portion in a circle D on the longitudinal sectional view.

As illustrated in FIG. 4A, the toner cartridge 100 includes a toner bottle 110, a fin 120, and a flange 130. The toner bottle 110 constituting the toner cartridge 100 corresponds to an example of the powder container according to the present disclosure.

The toner bottle 110 containing toner and other components are assembled into the toner cartridge 100 in the state illustrated in FIG. 4A. The toner cartridge 100 in the assembled state is accommodated in a horizontal posture in the image forming apparatus 1 illustrated in FIGS. 1 and 2. For this accommodation, the toner cartridge 100 is inserted into the image forming apparatus 1 in a direction of the arrow F. In addition, the toner cartridge 100 is pulled out in a direction of the arrow B when the toner bottle 110 becomes empty, and a new toner cartridge 100 is inserted.

The toner bottle 110 has a substantially cylindrical shape, has an opening 111 at one end, and accommodates toner in its interior. In addition, at the other end, a grip 112 is provided, which is to be gripped when the toner cartridge 100 is pulled out from the image forming apparatus 1. Further, a groove 113*a* extending in a spiral shape is formed on an outer peripheral surface 110*a* of the toner bottle 110. The spiral groove 113*a* is interrupted by a reinforcing rib, which is not illustrated in the drawings.

As illustrated in FIG. 4A, the back surface of the groove 113*a* protrudes from the inner peripheral surface 110*b* of the toner bottle 110. That is, a protrusion 113*b* extending in a spiral shape is formed on the inner peripheral surface 110*b* of the toner bottle 110. The toner bottle 110 rotates in a direction of the arrow R illustrated in FIG. 3 as described below. The toner bottle 110 is filled with toner (not illustrated). When the toner bottle 110 rotates, the toner is transported toward the opening 111 side by the spiral protrusion 113*b* on the inner peripheral surface 110*b*.

A male screw 119 is formed in the vicinity of the opening 111 on the outer peripheral surface 110*a* of the toner bottle 110. A female screw 122 (see FIG. 9) of the fin 120 is screwed to the male screw 119 so that the fin 120 is fixed to the toner bottle 110. Therefore, the toner bottle 110 and the fin 120 rotate together.

The fin 120 has a cylindrical portion 121, and the female screw 122 is formed on the inner peripheral surface of the cylindrical portion 121. The fin 120 also has a stirring bar 123 protruding in a direction of the arrow F. In this structure, the flange 130 has a hollow portion 131 (see FIG. 9) formed open toward the toner bottle 110. The stirring bar 123 of the fin 120 is disposed inside the hollow portion 131 of the flange 130. The stirring bar 123 turns around a rotation axis (in a direction of the arrow R) to stir toner, which moves from the opening 111 of the toner bottle 110 into the flange 130, in order to prevent toner aggregation. In addition, at the position of the rotation center of the fin 120, there is provided a fitting projection 124 protruding in a direction of the arrow F and having a fitting hole 124*a* formed in the center. On the other hand, a through hole 132 (see FIG. 9) is formed at a portion of a wall 137, which corresponds to a bottom plate of a cylindrical portion 131 of the flange 130, in a position facing the fitting projection 124. A coupling 139 is inserted into the through hole 132 from outside (left side in FIG. 9) the flange 130 and is fitted into the fitting hole 124*a*. When the toner cartridge 100 is inserted into the image forming apparatus 1 (see FIGS. 1 and 2), the coupling 139 is coupled to a coupling (not illustrated) of the main body of the apparatus. The coupling 139 is rotationally driven via the coupling of the main body of the apparatus by a motor (not illustrated) provided in the main body of the apparatus. The coupling 139 is fitted in the fitting hole 124*a* of the fin 120. As the coupling 139 rotates, the fin 120 also rotates together. The fin 120 is also fixed to the toner bottle 110. Therefore, as the fin 120 rotates, the toner bottle 110 also rotates together.

Figure 9:
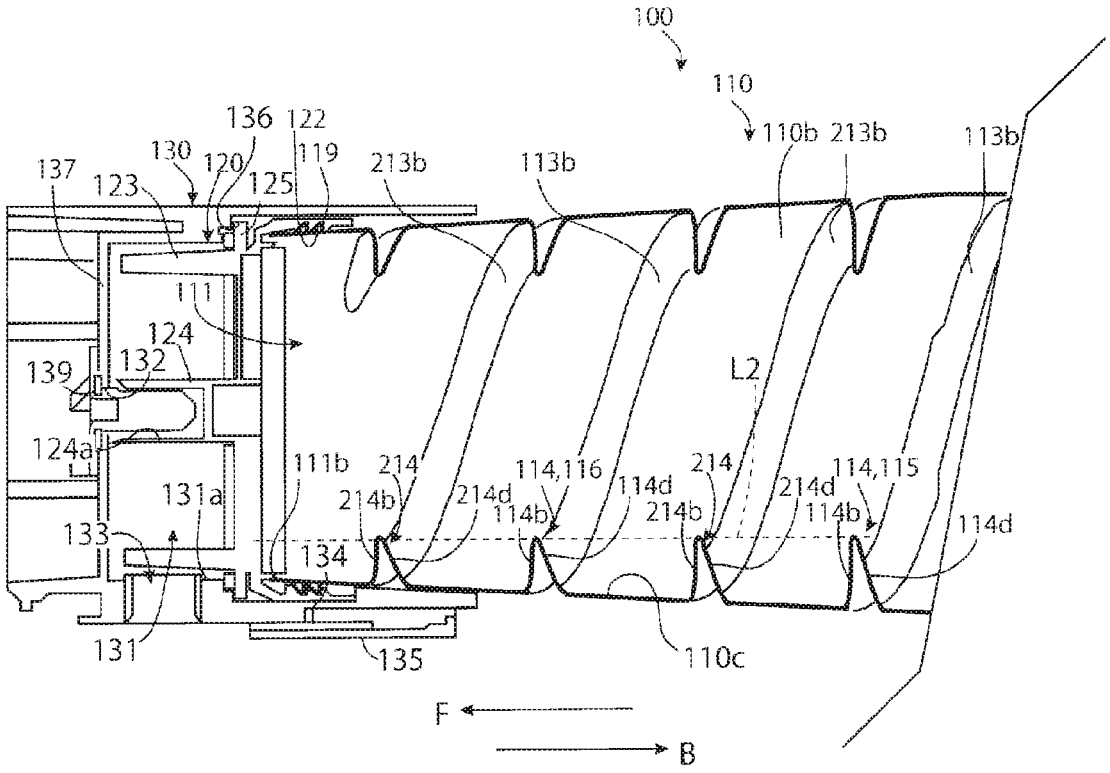
FIG. 9 is an enlarged view of a tapered portion in FIG. 8.

As illustrated in FIG. 9, the flange 130 has a locking groove 136, which runs around in a circumferential direction, on the inner wall surface 131*a* of the hollow portion 131. On the other hand, the fin 120 has a locking projection 125 to be fitted into the locking groove 136. The locking groove 136 allows the flange 130 to slide in a rotation direction (a direction of the arrow R illustrated in FIG. 3) while fixing the flange 130 to the fin 120 in a rotation axis direction (a left-right direction in FIG. 9). When the toner cartridge 100 is inserted into the image forming apparatus 1, the flange 130 is fixed on a cartridge mounting base 200 in a non-rotating state. Therefore, the fin 120 rotates while sliding with the locking groove 136 of the flange 130.

The flange 130 serves as a lid for the toner bottle 110 and has an outlet 133 through which toner flows out. In addition, the flange 130 has a shutter 135 which opens and closes the outlet 133. The shutter 135 is opened when the toner cartridge 100 is inserted into the image forming apparatus 1 and closed when the toner cartridge 100 is removed. FIG. 4A illustrates the shutter 135 in an open state. When the shutter 135 is closed, the outlet 133 is covered with a seal member 134 so that toner is prevented from leaking. When the toner cartridge 100 is inserted into the image forming apparatus 1, the shutter 135 is opened and the flange 130 is further held in a non-rotating state. Further, the coupling of the main body of the apparatus and the coupling 139 of the toner cartridge 100 are coupled to each other. The coupling 139 is rotationally driven via the coupling of the main body of the apparatus by a motor in the main body of the apparatus. The fin 120 and the toner bottle 110 of the toner cartridge 100 are rotated by the rotation driving. Toner in the toner bottle 110 is transported toward the opening 111 by the rotation of the toner bottle 110, so that the toner is transported out of the opening 111 and enters the hollow portion 131 of the flange 130. After entering the hollow portion 131 of the flange 130, the toner is stirred and scraped into the outlet 133 by the stirring bar 123 of the fin 120, and then flows out from the outlet 133 and to outside the toner cartridge 100.

The toner cartridge 100 described here represents toner cartridges 100Y, 100M, 100C, and 100K illustrated in FIG. 2. Therefore, after flowing out from the outlet 133 of the toner cartridge 100, the toner is supplied to the corresponding developing device 54 and used for forming a toner image.

As illustrated in FIG. 4A, the inner peripheral surface 110*b* of the toner bottle 110 has a flat portion Z1 on a side away from the opening 111 and a tapered portion Z2 on a side close to the opening 111. The flat portion Z1 has a cylindrical shape except for the protrusion 113*b* extending spirally. The tapered portion Z2 decreases in diameter toward the opening 111. Therefore, when the toner cartridge 100 is placed sideways, the bottom 110*c* of the inner peripheral surface 110*b* in the tapered portion Z2 forms a slope rising toward the opening 111.

In addition, when the toner bottle 110 is sectioned vertically on a plane including the rotation center line, the protrusion 113*b* causes plural projections 114 to appear on the cross-section illustrated in FIG. 4A.

Among the plural projections 114, when any one first projection (for example, a projection 115 illustrated in FIG. 4A) is compared with a second projection 116 closer to the opening 111 than the first projection, the bottom 116*c* of the opening 111-facing face 116*b* of the second projection 116 (see also FIG. 4B) is located at a position lower than the top 115*a* of the first projection 115. Alternatively, the projection 116 closest to the opening 111 may be designated as a first projection. In this case, when the top 116*a* of the first projection 116 is compared with the lower edge 111*b* of the opening 111, the lower edge 111*b* of the opening 111 is at a position lower than the top 116*a* of the first projection 116. In the exemplary embodiment illustrated in FIG. 4A, only one spiral protrusion 113*b* is formed. Therefore, all the projections 114 belong to the same spiral protrusion 113*b*. The projections 114 adjacent to each other satisfy the height relationship between the first and second projections.

Hereinafter, a case where the remaining amount of toner in the toner bottle 110 is small will be discussed. Even in such a case, when the projections 114 satisfy the above height relationship, the toner is gradually transferred to the adjacent projection 114 on the opening 111 side, and also in the tapered portion Z2 where the bottom 110*c* forms a slope rising toward the opening 111, the toner is gradually transported up to the adjacent projection 114 on the opening 111 side and then moved from the opening 111 to the hollow portion 131 of the flange 130. This makes it possible to reduce the remaining amount of toner in the toner bottle 110 for the replacement of the toner cartridge 100.

In this regard, attention may be paid to the height h of each projection 114, which is from the bottom of the opening 111-facing face (for example, from the bottom 116*c* of the opening 111-facing face 116*b* of the projection 116 illustrated in FIG. 4B) to the top of the projection 114 (for example, to the top 116*a* of the projection 116). In the exemplary embodiment illustrated in FIG. 4A, the height h of the plural projections 114 appearing in the tapered portion Z2 is greater than the average of the heights h of the plural projections 114 appearing in the flat portion Z1. Specifically, the plural projections 114 in the flat portion Z1 have the same first height. The plural projections 114 in the tapered portion Z2 also have the same height. In other words, when the tops 114*a* of the plural projections 114 in the tapered portion Z2 are connected by a line L, the line L is parallel to the bottom 110*c* of the inner peripheral surface 110*b* as illustrated in FIGS. 4A and 4B. In this manner, the plural projections 114 in the tapered portion Z2 have a second height greater than the first height in the flat portion Z1. In the present exemplary embodiment, therefore, the strength of transfer of the toner to the adjacent projection 114 on the opening 111 side is enhanced in the tapered portion Z2 in which the bottom 110*c* forms a slope rising toward the opening 111. On the other hand, the volume of the toner bottle 110 is increased as compared with the case where the height h in the flat portion Z1 is the same as the height h in the tapered portion Z2.

Next, a second exemplary embodiment and other exemplary embodiments will be described. The second exemplary embodiment and other exemplary embodiments differ from the first exemplary embodiment only in the toner bottle 110 of the toner cartridge 100. Therefore, the description of the overall configuration illustrated in FIGS. 1 and 2 will not be repeated. In addition, components of the toner cartridge 100 are also denoted by the same reference numerals as those in FIGS. 3 and 4, and the description of the same features as in the first exemplary embodiment will not be repeated.

Figure 5:
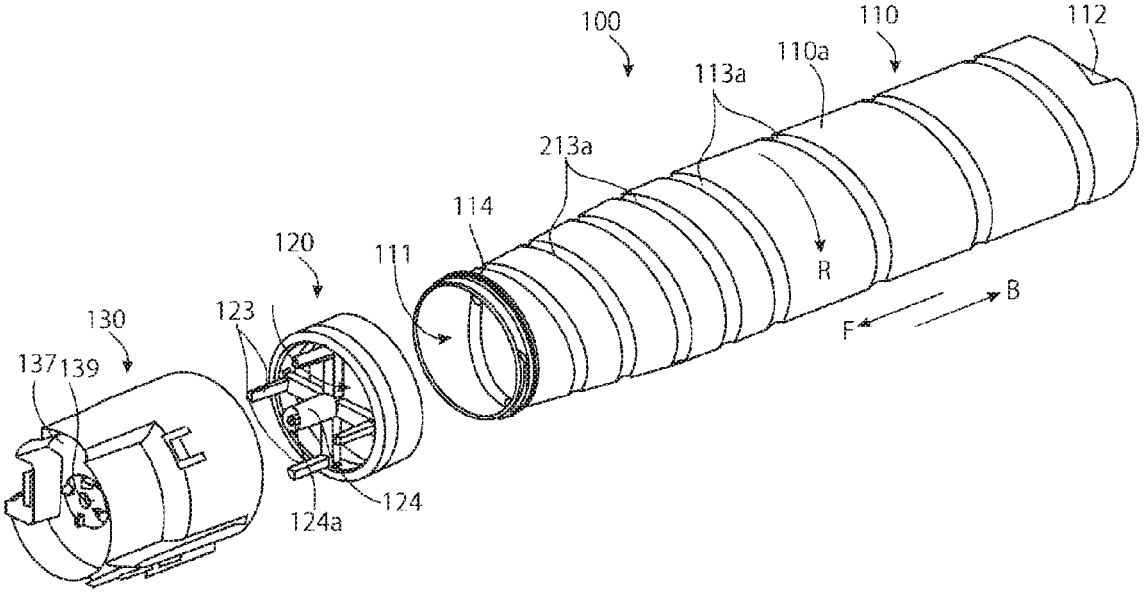
FIG. 5 is an exploded perspective view of a toner cartridge according to a second exemplary embodiment employed in the image forming apparatus illustrated in FIGS. 1 and 2.

FIG. 5 is an exploded perspective view of a toner cartridge according to the second exemplary embodiment employed in the image forming apparatus illustrated in FIGS. 1 and 2.

Figure 6A:
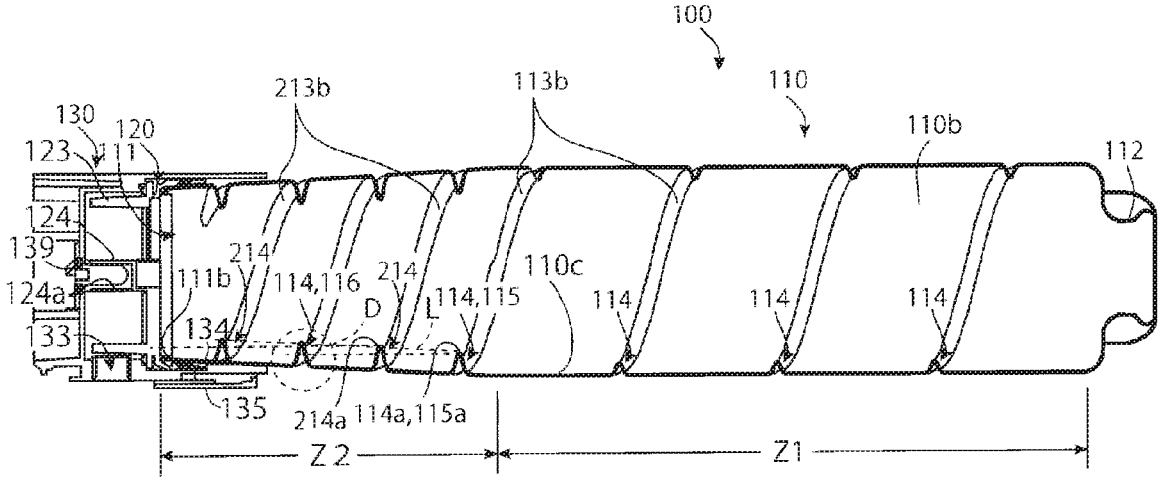
FIG. 6A is a longitudinal sectional view of the toner cartridge illustrated in FIG. 5.
Figure 6B:
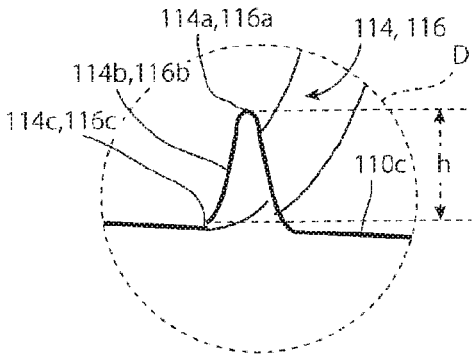
FIG. 6B is an enlarged view of a portion in a circle D on the longitudinal sectional view.

In addition, FIG. 6A is a longitudinal sectional view of the toner cartridge illustrated in FIG. 5, and FIG. 6B is an enlarged view of a portion in a circle D on the longitudinal sectional view.

In addition to the groove 113*a* extending in a spiral shape, another groove 213*a* is formed on the outer peripheral surface 110*a* of the toner bottle 110 only in the tapered portion Z2. This groove 213*a* also extends spirally. The groove 213*a* is also interrupted by a reinforcing rib although the reinforcing rib is not illustrated in the drawings.

As illustrated in FIGS. 6A and 6B, back surfaces of the two grooves 113*a* and 213*a* protrude to the inner peripheral surface 110*b* of the toner bottle 110. Specifically, one protrusion 113*b* extending in a spiral shape and another protrusion 213*b* also extending in a spiral shape are formed on the inner peripheral surface 110*b* of the toner bottle 110. The toner bottle 110 rotates in a direction of the arrow R illustrated in FIG. 5. The toner bottle 110 is filled with toner (not illustrated), and when the toner bottle 110 rotates, the toner is transported toward the opening 111 by the spiral protrusions 113*b* and 213*b* on the inner peripheral surface 110*b*.

As illustrated in FIG. 6A, when the toner bottle 110 is sectioned vertically on a plane including a rotation center line, the protrusion 113*b* causes plural projections 114 to appear on the cross-section, and the other protrusion 213*b* also causes plural projections 214 to appear on the cross-section. Among the plural projections 114 and 214, when any one first projection (for example, a projection 115 illustrated in FIG. 6A) is compared with a second projection 116 that belongs to the same spiral and is closer to the opening 111 than the first projection, the bottom 116*c* of the opening 111-facing face 116*b* of the second projection 116 (see also FIG. 6B) is located at a position lower than the top 115*a* of the first projection 115. Alternatively, among the projections 114 belonging to a single spiral, the projection 116 closest to the opening 111 may be designated as a first projection. In this case, when the top 116*a* of the first projection 116 is compared with the lower edge 111*b* of the opening 111, the lower edge 111*b* of the opening 111 is at a position lower than the top 116*a* of the first projection 116. In the second exemplary embodiment illustrated in FIG. 6A, two spiral protrusions 113*b* and 213*b* are formed. The adjacent projections 114 and 214 for each spiral satisfy the height relationship between the first and second projections. Specifically, the projections 114 and 114 adjacent to each other belonging to one spiral satisfy the height relationship between the first and second projections described above, and the projections 214 and 214 adjacent to each other belonging to another spiral also satisfy the height relationship between the first and second projections described above.

Hereinafter, a case where the remaining amount of toner in the toner bottle 110 is small will be discussed. Even in such a case, when the projections 114 and 214 satisfy the height relationship, the toner is gradually transferred to the adjacent projections 114 on the opening 111 side among the projections 114 belonging to the same spiral. The same thing occurs also in the tapered portion Z2 where the bottom 110*c* forms a slope rising toward the opening 111. Also in the tapered portion Z2, the toner is gradually transported up to the adjacent projections 114 and 214 on the opening 111 side belonging to the same spiral and then moved from the opening 111 to the hollow portion 131 of the flange 130. When the remaining amount of toner becomes small, no toner may be transferred between the projections 114 and 214 belonging to different spiral. Therefore, the above relationship needs to be satisfied between the projections 114 and 214 belonging to the same spiral. In the second exemplary embodiment, the above relationship is satisfied between the projections 114 and 214 belonging to the same spiral, so that the toner can be gradually transferred, which makes it possible to reduce the remaining amount of the toner in the toner bottle 110 for the replacement of the toner cartridge 100.

In this regard, attention may be paid to the height h of each of the projections 114 and 214, which is from the bottom of the opening 111-facing face (for example, from the bottom 116*c* of the opening 111-facing face 116*b* of the projection 116 illustrated in FIG. 6B) to the top of the projection 114 (for example, to the top 116*a* of the projection 116). In the exemplary embodiment illustrated in FIG. 6A, the height h of the plural projections 114 appearing in the tapered portion Z2 is greater than the average of the heights h of the plural projections 114 appearing in the flat portion Z1. Specifically, the plural projections 114 in the flat portion Z1 have the same first height. The plural projections 114 and 214 in the tapered portion Z2 also have the same second height. In other words, when the tops 114*a* and 214*a* of the plural projections 114 and 214 in the tapered portion Z2 are connected by a line L, the line L is parallel to the bottom 110*c* of the inner peripheral surface 110*b* as illustrated in FIGS. 6A and 6B. In this regard, the plural projections 114 in the tapered portion Z2 have the second height greater than the first height in the flat portion Z1. In the present exemplary embodiment, therefore, the strength of transfer of the toner to the adjacent projection 114 on the opening 111 side is enhanced in the tapered portion Z2 in which the bottom 110*c* forms a slope rising toward the opening 111. On the other hand, the volume of the toner bottle 110 is increased as compared with the case where the height h in the flat portion Z1 is the same as the height h in the tapered portion Z2.

Figure 7:
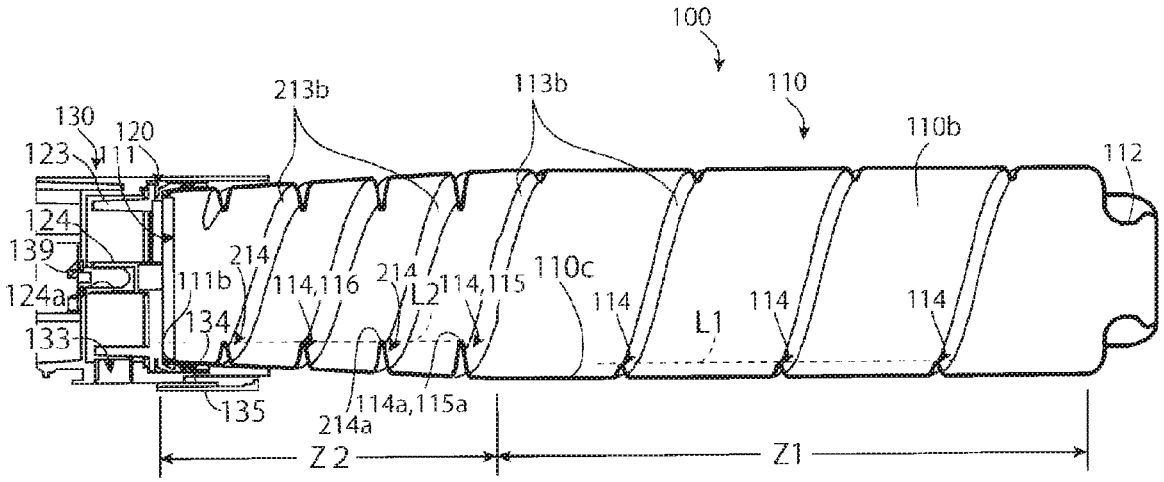
FIG. 7 is a longitudinal sectional view of a toner cartridge according to a third exemplary embodiment.

FIG. 7 is a longitudinal sectional view of a toner cartridge according to a third exemplary embodiment. The third exemplary embodiment differs from the second exemplary embodiment only in the height of the protrusions 113*b* and 213*b* of the toner bottle 110.

In the third exemplary embodiment illustrated in FIG. 7, the tops 114*a* of the plural projections 114 in the flat portion Z1 have the same height as in the first and second exemplary embodiments. That is, the tops 114*a* can be connected by a horizontal line. In the third exemplary embodiment, the tops 114*a* and 214*a* of the plural projections 114 and 214 in the tapered portion Z2 can also be connected by a horizontal line, while, in the first and second exemplary embodiments, the line connecting the tops 114*a* and 214*a* of the plural projections 114 and 214 in the tapered portion Z2 is parallel to the bottom 110*c* of the inner peripheral surface 110*b*. The tops 114*a* and 214*a* of the plural projections 114 and 214 in the tapered portion Z2 are positioned higher than the tops 114*a* of the plural projections 114 in the flat portion Z1. In addition, the tops 114*a* and 214*a* of the plural projections 114 and 214 in the tapered portion Z2 are positioned higher than the lower edge 111*b* of the opening 111.

In the present exemplary embodiment, this feature enhances the strength of transfer of the toner in the tapered portion Z2 where the bottom 110*c* forms a slope rising toward the opening 111. On the other hand, the volume of the toner bottle 110 is increased as compared with the case where the height of the top 114*a* of the projection 114 in the flat portion Z1 is the same as the height of the tops 114*a* and 214*a* of the projections 114 and 214 in the tapered portion Z2. Also in the present exemplary embodiment, the strength of pushing the toner toward the opening 111 is enhanced as compared with the case where the tops 114*a* and 214*a* of the projections 114 and 214 in the tapered portion Z2 are positioned lower than the lower edge 111*b* of the opening 111.

Figure 8:
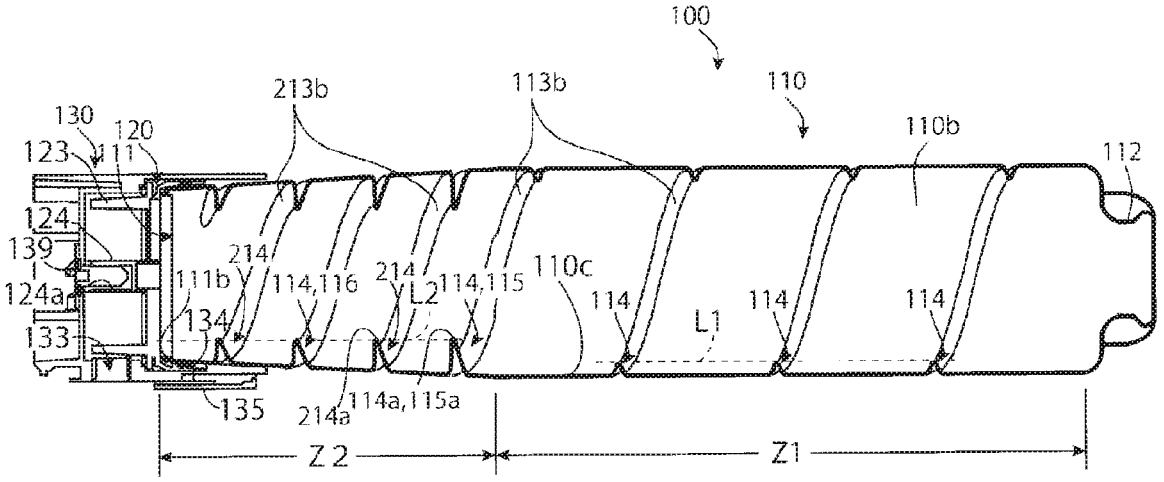
FIG. 8 is a longitudinal sectional view of a toner cartridge according to a fourth exemplary embodiment.

FIG. 8 is a longitudinal sectional view of a toner cartridge according to a fourth exemplary embodiment.

In addition, FIG. 9 is an enlarged view of a part of a tapered portion in FIG. 8.

The fourth exemplary embodiment differs from the third exemplary embodiment in the shape of the protrusions 113*b* and 213*b* in the tapered portion Z2 of the toner bottle 110.

In the present exemplary embodiment, on the cross-section illustrated in FIGS. 8 and 9, the bottom 110*c* of the inner peripheral surface 110*b* in the tapered portion Z2 of the toner bottle 110 forms a slope rising toward the opening 111. In the present exemplary embodiment, the opening 111-facing faces 114*b* and 214*b* of the plural projections 114 and 214 appearing on the rising slope rise more steeply than the faces 114*d* and 214*d* facing opposite to the opening 111. In the present exemplary embodiment, the strength of pushing the toner is enhanced by the steep rise of the faces 114*b* and 214*b* facing the opening 111. The steep rise of the faces 114*b* and 214*b* facing the opening 111 is effective in enhancing the strength of pushing the toner not only in the toner bottle 110 having the flat portion Z1 and the tapered portion Z2 but also in a toner bottle gradually decreasing in diameter toward the opening 111, namely, a toner bottle tapered over the entire length, which forms a slope rising toward the opening 111.

According to each exemplary embodiment described above, the remaining amount of toner at the time of replacement is reduced as compared with a toner bottle in which a spiral protrusion having a constant height is formed on the inner peripheral surface.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A container comprising:

a bottle body configured to accommodate powder, wherein the bottle body has, at one end, an opening configured to allow the powder to flow out, wherein the bottle body is positioned with the opening facing laterally, wherein the bottle body is rotatable about a rotation center line extending laterally through a center of the opening, wherein the bottle body comprises an inner peripheral surface on which a spiral protrusion is formed, wherein the spiral protrusion is configured to transport the accommodated powder toward the opening if the bottle body is rotated about the rotation center line, wherein if the bottle body is sectioned vertically on a plane including the rotation center line, the spiral protrusion causes a plurality of upwardly protruding projections to appear on a cross-section, wherein on the cross-section, a bottom of the inner peripheral surface forms a slope rising toward the opening, wherein the projections appearing on the slope each have an opening-facing face and a face facing opposite to the opening, and wherein the opening-facing face rises more steeply than the face facing opposite to the opening.

2. The container according to claim 1, wherein the second projection is a projection adjacent to the opening among projections belonging to the same spiral as the spiral to which the first projection belongs.

3. The container according to claim 1, wherein the bottle body has a flat portion on a side away from the opening and has a tapered portion on a side closer to the opening, wherein the flat portion has an inner wall surface forming a cylindrical shape except for the protrusion, and wherein the tapered portion decreases in diameter toward the opening.

4. The container according to claim 3, wherein an average of heights of the projections, each from the bottom of the opening-facing face of the projection to the top of the projection, is greater in the tapered portion than in the flat portion.

5. The container according to claim 4, wherein the projections in the flat portion have a same first height from the bottom of the opening-facing face to the top of the projection, wherein the projections in the tapered portion have a same second height from the bottom of the opening-facing face to the top of the projection, and wherein the second height is greater than the first height.

6. The container according to claim 4, wherein tops of the projections in the flat portion have a same third height, wherein tops of the projections in the tapered portion have a same fourth height, and wherein the fourth height is greater than the third height.

7. The container according to claim 6, wherein the tops of the projections in the tapered portion are located at a position higher than the lower edge of the opening.

8. An image forming apparatus comprising:

the container according to claim 1, wherein the image forming apparatus is configured to form an image if supplied with powder from the container.

9. A container comprising:

a bottle body configured to accommodate powder, wherein the bottle body has, at one end, an opening configured to allow the powder to flow out, wherein the bottle body is positioned with the opening facing laterally, wherein the bottle body is rotatable about a rotation center line extending laterally through a center of the opening, wherein the bottle body comprises an inner peripheral surface on which a spiral protrusion is formed, wherein the spiral protrusion is configured to transport the accommodated powder toward the opening if the bottle body is rotated about the rotation center line, wherein if the bottle body is sectioned vertically on a plane including the rotation center line, the spiral protrusion causes a plurality of upwardly protruding projections to appear on a cross-section, wherein the bottle body has a tapered portion on a side close to the opening, wherein the tapered portion decreases in diameter toward the opening, wherein the projections in the tapered portion each have an opening-facing face and a face facing opposite to the opening, and wherein the opening-facing face rises more steeply than the face facing opposite to the opening.

10. An image forming apparatus comprising:

the container according to claim 9, wherein the image forming apparatus is configured to form an image if supplied with powder from the container.

11. A container comprising:

a bottle body configured to accommodate powder, wherein the bottle body has, at one end, an opening configured to allow the powder to flow out, wherein the bottle body is positioned with the opening facing laterally, wherein the bottle body is rotatable about a rotation center line extending laterally through a center of the opening, wherein the bottle body comprises an inner peripheral surface on which a spiral protrusion is formed, wherein the spiral protrusion is configured to transport the accommodated powder toward the opening if the bottle body is rotated about the rotation center line, wherein if the bottle body is sectioned vertically on a plane including the rotation center line, the spiral protrusion causes a plurality of upwardly protruding projections to appear on a cross-section, wherein on the cross-section, a bottom of the inner peripheral surface forms a slope rising toward the opening, wherein the projections appearing on the slope each have an opening-facing face and a face facing opposite to the opening, wherein the projections appearing on the slope include a first projection and a second projection closer to the opening than the first projection, and wherein a height from the bottom of the opening-facing face to a top of the second projection is lower than the height of the first projection.

* * * * *